United States Patent [19]

Mackal

[11] 4,260,075

[45] Apr. 7, 1981

[54] AUTOMATIC INFLATOR

[76] Inventor: Glenn H. Mackal, Buena Vista Dr., Ringwood, N.J. 07456

[21] Appl. No.: 930,035

[22] Filed: Aug. 1, 1978

[51] Int. Cl.[3] ..... B67B 7/24

[52] U.S. Cl. ..... 222/5; 9/318

[58] Field of Search ..... 9/9, 314, 316, 317, 9/318, 319, 320, 323, 324; 144/38, 329; 222/5, 54

[56] References Cited

U.S. PATENT DOCUMENTS

| | | | |
|---|---|---|---|
| 2,513,347 | 7/1950 | Myers | 222/5 |
| 3,490,648 | 1/1970 | Fujimoto | 222/5 |
| 3,815,783 | 6/1974 | Hirata | 9/314 X |
| 3,934,292 | 1/1976 | Mulderrig | 9/318 |
| 3,997,079 | 12/1976 | Niemann | 9/318 X |

*Primary Examiner*—Sherman D. Basinger
*Attorney, Agent, or Firm*—Klein & Vibber

[57] ABSTRACT

There is disclosed an inflator for the inflation of inflatable articles such as life vests and the like, such inflator being operated automatically upon being subjected to water as upon the ditching or parachuting of an aviator wearing a life vest provided with such inflator. In the preferred embodiment of the inflator disclosed, the automatically operating portion of it is embodied as an attachment to a known manually operated inflator, the resulting inflator being capable of operation both manually and automatically. The automatically operating portion of the inflator incorporates a latch which holds a plunger operated by a coil compression spring in cocked condition until the latch releases the plunger, which thereafter thrusts a gas-containing capsule against a piercing pin, so that the pin passes through the sealing diaphragm of the capsule. The latch is provided with a water-destructible member which retains the latch in plunger-cocking position until the water-destructible member is subjected to water in an amount sufficient to weaken it so that the latch releases the plunger.

14 Claims, 12 Drawing Figures

AUTOMATIC INFLATOR

This application is related to the pending application of Glenn H. Mackal, Ser. No. 931,271 filed Aug. 4, 1978, and to the pending application of Glenn H. Mackal, Ser. No. 931,432, filed Aug. 7, 1978.

This application relates to an automatic inflator for inflatable articles such as life vests and the like. In the disclosed preferred embodiment thereof, the inflator is capable of operation both manually and automatically, the automatically operating portion of the apparatus being preferably embodied as an attachment to a previously known manually operated inflator, the resulting, combined device retaining its ability to be operated manually while adding the capability of being operated automatically upon its subjection to water as being submerged therein when employed with a life vest worn by a ditching or parachuting aviator.

Automatic inflators have been previously proposed. Among such prior disclosed automatic inflators are the following: Muller, U.S. Pat. No. 1,329,990, Spidy, U.S. Pat. No. 2,894,658, Waters U.S. Pat. No. 3,242,514, Fujimoto, U.S. Pat. No. 3,494,506, and Niemann, U.S. Pat. No. 3,997,079. Of these patents, only those to Fujimoto and Niemann disclose automatic inflators which are also capable of operation manually. In Fujimoto a level-operated cam, an automatic, water-responsive mechanism, and a gas capsule which is moved toward a stationary piercing pin are arranged in that order. The operation of the inflator manually by the lever-operated cam may well cause operation of the automatic inflator portion of the device, a result which is neither necessary nor desirable. In Niemann, although the automatically operating portion of the device is disposed in series in that order with the manually operating portion thereof and the piercing pin, a part of the automatically operating mechanism is disposed in a first, removable part of the housing and another part of the automatically operating mechanism is disposed in a second part of the housing, and remains therein when the first part of the housing is removed and the inflator is operated only manually. Further, the removal of the first housing part leaves the second housing part in open condition, vulnerable to its being fouled both by physical and atmospheric agencies.

It is among the objects of the present invention to overcome the outlined disadvantages of the prior art and to provide and automatically operated mechanism, responsive to being immersed in water, to effect the piercing of a gas-containing capsule, which may be easily attached to and held securely as a part of a manually operable inflator which by itself is complete. The automatic inflator of the invention may be either supplied to the trade as a separate item, which can be easily attached to existing manually operated inflators, or the combined automatic mechanism and the manually operated inflator may be assembled and sold as a unit.

The invention will be more readily understood upon consideration of the accompanying drawings, in which.

Figure 1:
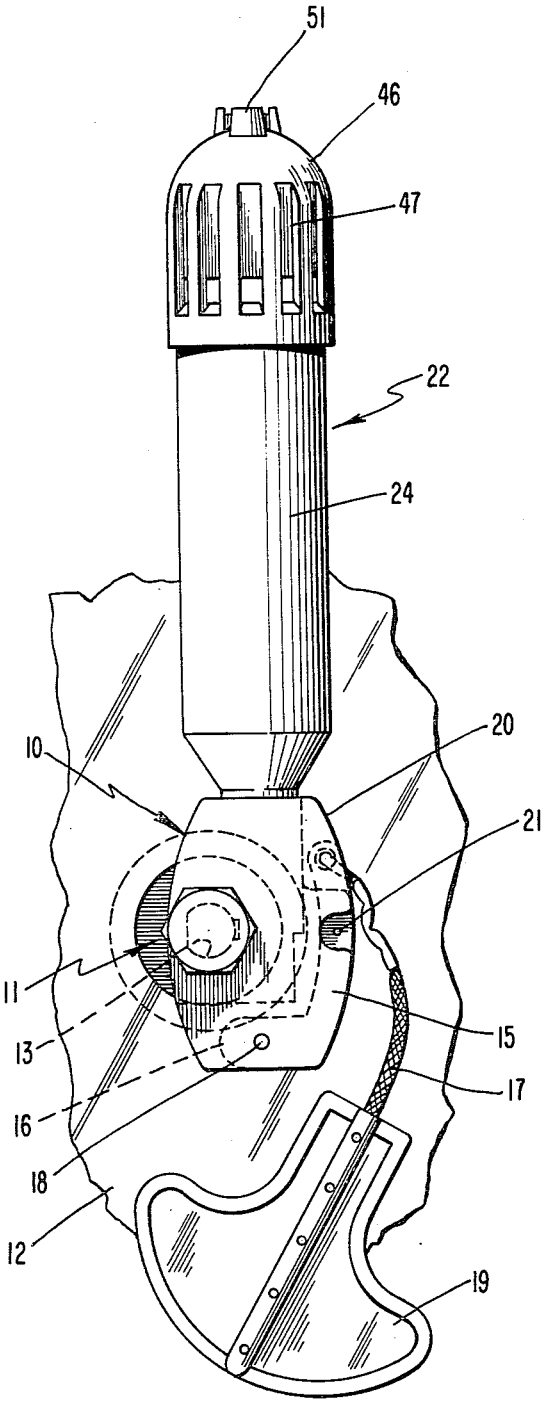
FIG. 1 is a view in side elevation of a preferred embodiment of the automatic inflator of the invention, such inflator being shown attached by a fitting to a portion of the wall of an inflatable article, the inflator shown including a prior, manually operable inflator to which there has been added a mechanism for rendering the inflator automatically operable upon being immersed in water.

Turning now to FIG. 1, there is there shown a manually operated inflator 10 which is substantially shown in Mackal U.S. Pat. No. 3,809,288, May 7, 1974. Inflator 10 is attached by a fitting generally designated 11 to an inflatable article, a part of the wall of which is shwon at 12. A capsule 14 containing gas such as $CO_2$ under pressure is mounted within the hollow main body 24 of a housing, the housing being secured and sealed to the body 20 of the manual inflator 10 in a manner to be described. When a sealing means such as a diaphragm which spans the neck of the capsule 14 is pierced, gas is released from the capsule and flows into a chamber within the body 20 from which it is discharged through the fitting 11, which is mounted and sealed in an opening 13 in the body 20. The piercing of the seal of the capsule 14 by the manually operated inflator 10 is effected by the turning of a lever 15 by a lanyard 17 about a pivot pin 18 upon which it is mounted on tbe body 20, thereby to cause a cam 16 integral with the level 15 to advance a piercing pin against and through a seal such as a diaphragm on the neck of the capsule. The lanyard 17 is provided with a handle 19 by which the lanyard may be pulled to fracture a frangible pin 21 which passes through aligned openings in the body 20 and through the level 15, as shown. The manual operation of the inflator 20 is illustrated in FIG. 5, which shows the lever 15 as having been swung clockwise, the automatic mechanism for thrusting the capsule toward the piercing pin then remaining cocked and inoperative.

Figure 2:
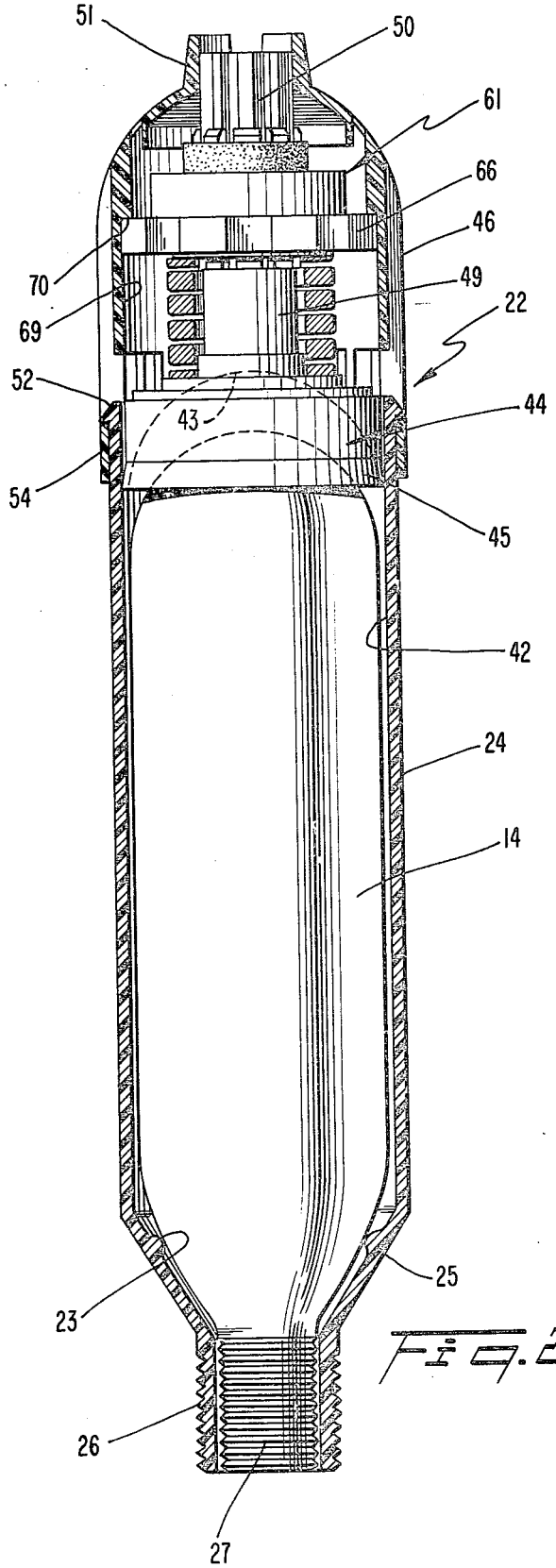
FIG. 2 is a view in longitudinal axial section through the mechanism for rendering the inflator automatically operable.

The automatic inflating mechanism, which is generally designated by the reference character 22, is composed generally of a hollow main body 24 which is circular cylindrical throughout its main extent, but has a frusto-conical portion 25 at its axially inner end, portion 25 terminating in an externally threaded neck 26. The capsule 14 has an outer diameter somewhat less than the inner diameter of the main body 24 of the housing, so that the capsule may slide freely axially therewithin. In FIG. 2 the capsule 14 is shown in the position which it assumes after it has been mounted in the mechanism 22 but before mechanism 22 has been screwed onto the body 20 of the manual inflator 10. As shown in FIG. 2, the inner generally frusto-conical neck portion of the capsule rests upon a series of radially inwardly projecting lugs 23 on the portion 25 of the body 24, the externally threaded neck 27 of the capsule then lying fully within the threaded neck 26 of the body 24. When mechanism 22 is then mounted upon the inflator 10 with the plunger 44 in its cocked, axially outer, position, as shwon in FIG. 3, the capsule 14 has freedom of axial movement within the hollow body 24 from a position in which the rounded outer end of the capsule 14 engages the inner surface of plunger 44 to a member or diaphragm 34 of the capsule engages, but is not pierced by, the piercing pin 41.

Figure 3:
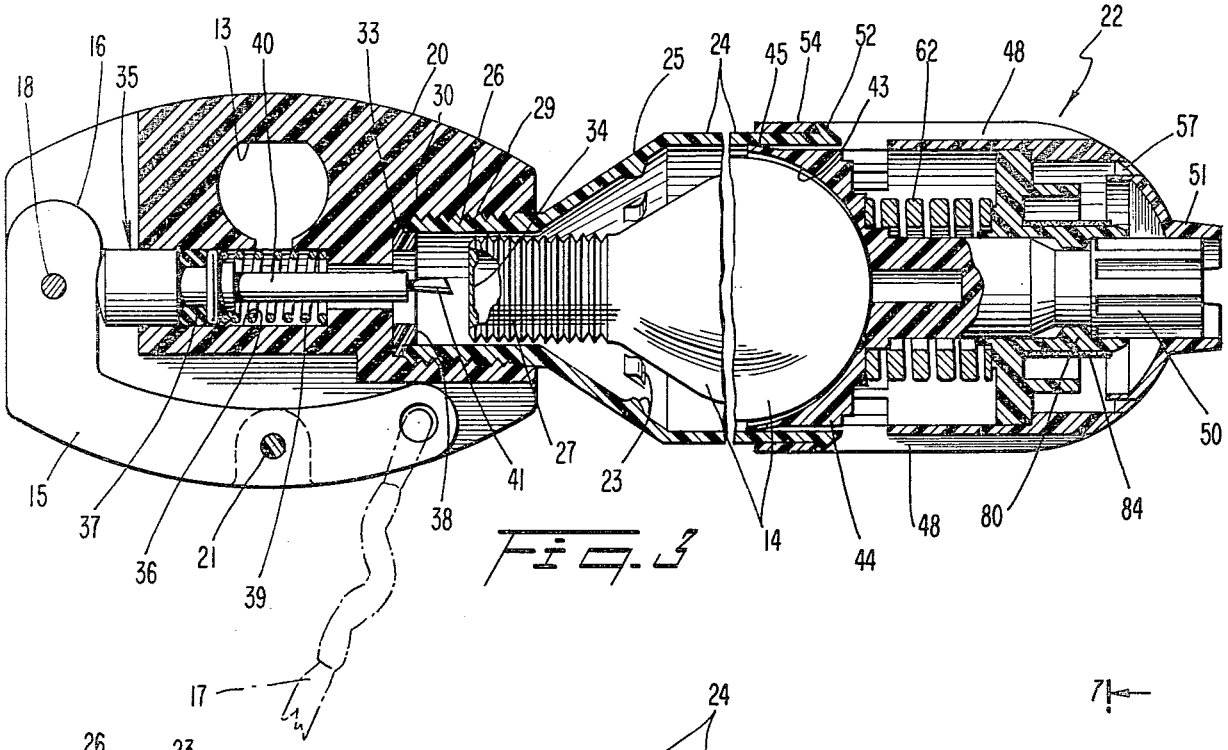
FIG. 3 is a fragmentary view in axial section through the inflator of FIG. 1, the mechanism for rendering the inflator automatically operable being shown in cocked condition.
Figure 5:
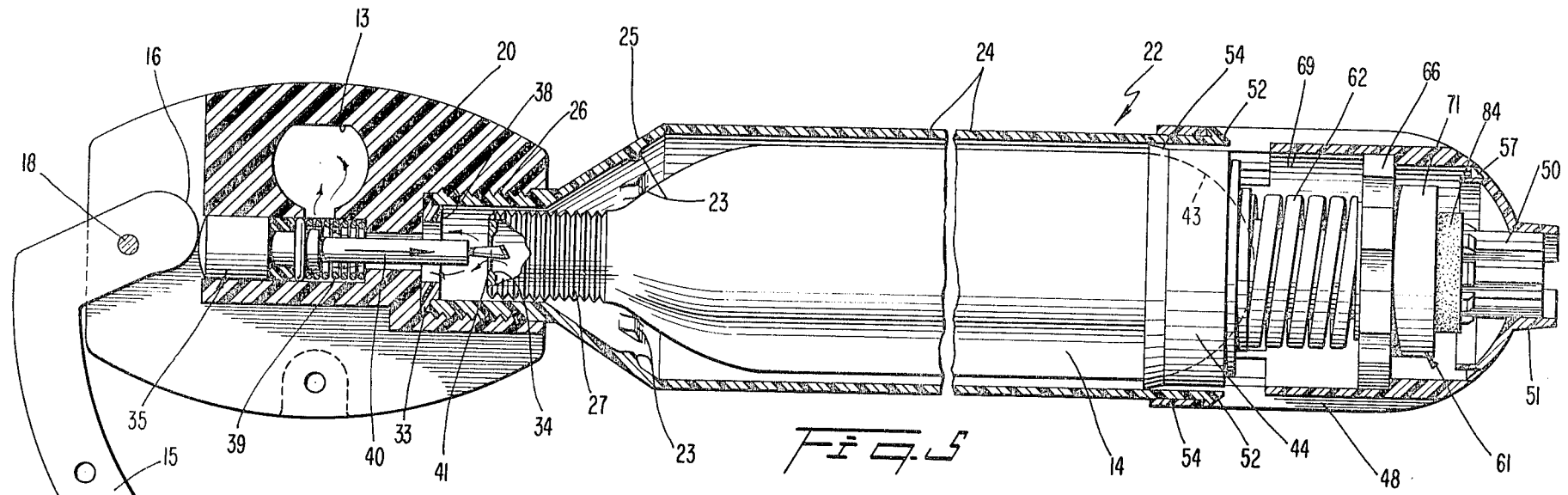
FIG. 5 is a view similar to FIG. 3 but showing the inflator after the manually operated portion thereof has been operated to pierce the sealing diaphragm of a gas-containing capsule.
Figure 6:
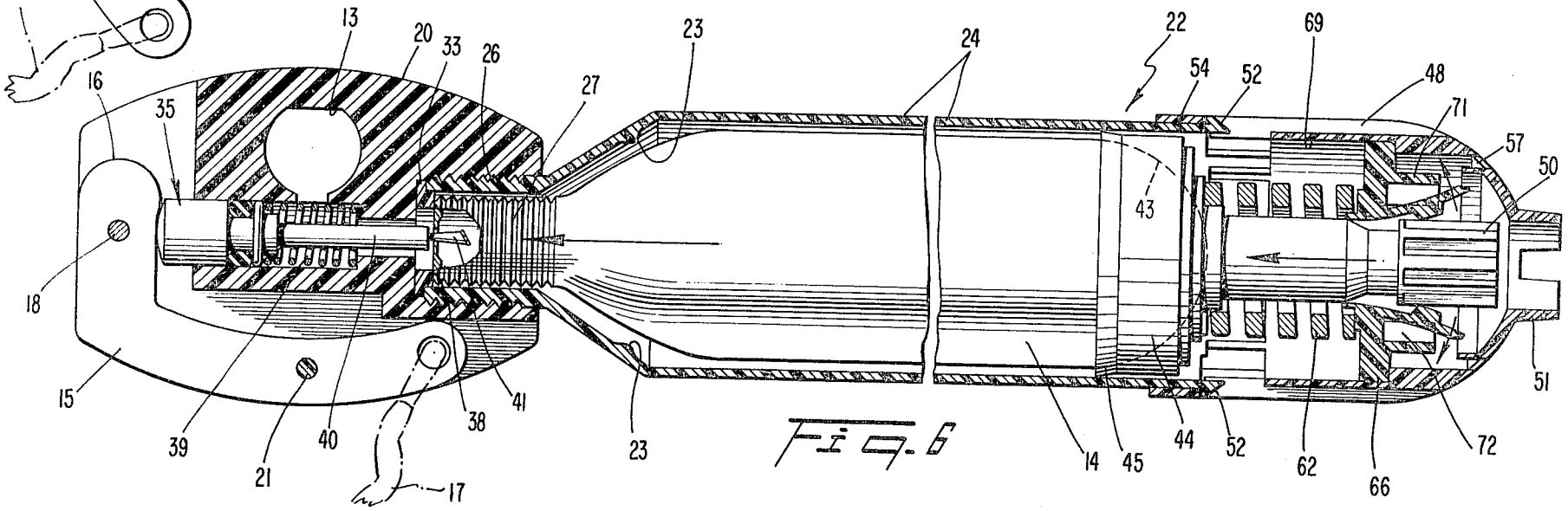
FIG. 6 is a view similar to FIG. 3 but with the manual inflator in unoperated condition, and with the mechanism for rendering the inflator automatically operable having been operated to pierce the sealing diaphragm of the gas-containing capsule.
Figure 7:
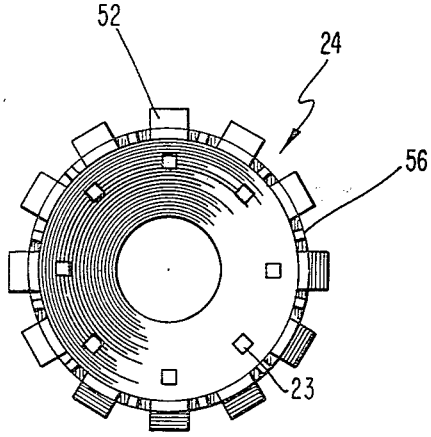
FIG. 7 is a view in end elevation of the capsule-housing portion of the inflator, the view being taken along the line 7—7 in FIG. 4.
Figure 8:
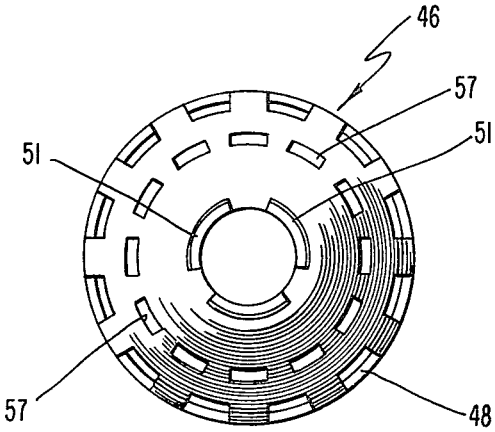
FIG. 8 is a view in end elevation of the cap which fits upon the body of the gas capsule-housing portion of the inflator, the view being taken from the line 8—8 in FIG. 4.
Figure 9:
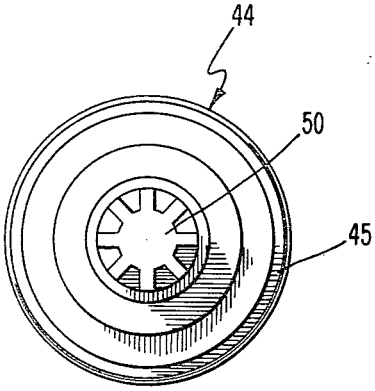
FIG. 9 is a view in end elevation of the gas capsule-impelling plunger of the inflator, the view being taken from the outer end of such plunger.
Figure 10:
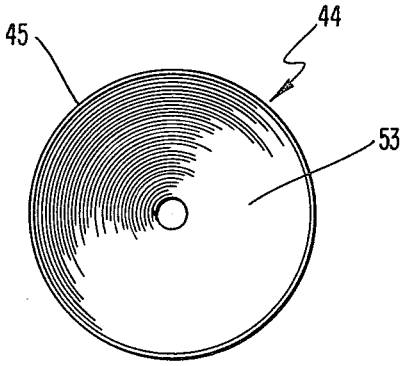
FIG. 10 is a view in end elevation of the gas capsule-impelling plunger, the view being taken from the inner end of the plunger.

As shown in FIGS. 3, 5, and 6, the body 20 of the manual inflator 10 has an internally threaded opening 29 therein which threadedly receives the neck 26 of the main body 24 of the housing. A single gasket generally designated 30 is employed to seal the neck 26 to the body 20 of the inflator, to seal the transverse inner end of the neck 27 of the capsule 14 to the body 320 but to permit the capsule 14 to be thrust in the direction from right to left when the inflator is automaticcally operated to move the capsule 14 against the piercing pin of the inflator. To fulfill such functions, the gasket 30 has a radially outer, axially thinner annular portion 33 which is interposed between the transverse axially inner face of the neck 26 of the housing portion 24 when the housing is screwed home into the threaded opening 29 in body 20 of the inflator 10. The gasket 30 has a radially inner, axially thicker annular portion 38 which is disposed in alignment with the transverse annular surface of the neck 27 of the capsule 14 and extends axially toward it from portion 33 of the gasket and is telescoped within the neck 26 of part 24. It will be seen that when the gas capsule 14 has been thrust to the left into the position shown in FIG. 6, the gasket 30 seals both the housing portion 24 and the gas capsule 14 to the body 20 of the inflator 10, thereby preventing the leakage of gas from the connection therebetween.

The diaphragm-like sealing member across the neck of the capsule has a thinner central portion 34 which is pierced by the active axially outer end 41 of the piercing pin. Piercing pin 41 is that which is shown in the application of Glenn H. Mackal Ser. No. 916,497, filed June 19, 1978 now abandoned, which is incorporated herein in its entirety.

The piercing pin, which is generally designated by the reference character 35, has an enlarged axially inner end which is slidingly received in a bore 36 in the body 20 of the inflator, the piercing pin being sealed therein by an O-ring 37. A coil compression spring 39 telescoped over the shank 40 of the piercing pin constantly urges the enlarged axially inner end of the pin into contact with the cam 16. The active, forward end 41 of the piercing pin is of frusto-conical shape, and has an angularly disposed outer or forward cutting edge. The cam 16 has a circular configuration past its high point, so that upon the swinging of the lever 15 into the position shown in FIG. 5, the active outer end 41 of the piercing pin remains within the neck of the capsule 14, gas escaping from the capsule through the annular space presented between the inner edge of the whole cut in the diaphragm 34 and the side surfaces of the portion 41 of the piercing pin. As shown in FIG. 6, the same gas escape path is presented between the inner edge of the whole cut in the seal 34 and the side surfaces of the portion 41 of the piercing pin.

The Automatic Inflator Mechanism

The automatic inflator mechanism 22 includes a piston-like member or plunger 44 which has a flared, yieldable axially inner sealing edge 45 which sealingly engages the circular cylindrical inner surface 42 of the main body 24 of the housing. The member 44 has an upwardly concave, part-spherical inner surface 43 having generally the same shape and size as the upper (FIG. 2) end of the capsule 14. The housing is completed by a cap 46 which has a plurality of axially extending evenly-spaced grooves 48 therein, the axially inner ends of the grooves 48 terminating in openings 47 which lie axially outwardly of a continuous circular cylindrical skirt 54 on the cap. The piston-like member 44 has an outwardly extending central stem having a smooth circular cylindrical portion 49 axially inwardly thereof and an axially fluted outer end portion 50. Portion 50 extends through an opening presented between three equally-spaced axially outwardly extending guides 54 when the automatic inflator mechanism is cocked as shown in FIGS. 3 and 5. The stem 49, 50 may be of a color which is readily distinguished from that of the cap 46, so that the cocked condition of the automatic inflator mechanism may be readily discerned.

The cap 46 is retained upon the main body 24 of the housing by the snapping of hook-like radially outwardly extending porjections 52 on the outer end of the body 24 through the openings 47 in the skirt of the cap, the hooks 52 being securely engaged with the shoulders 55 at the axially inner ends of the openings 47 in the cap. The skirt 54 loosely fits over the outer end of the main body 24 of the housing so as to permit the ingress of water therebetween, there being provided an axial extension 56 between successive members 52 on the body 24 so as to prevent the ingress of foreign bodies into the interior of housing. The axially inner surface of the piston-like member 44 is of part-spherical shape, so as to receive therewithin the rounded outer end of the capsule 14. As shown in FIG. 2, the rounded outer end of the capsule 14 is spaced somewhat axially from the cocked spherical inner surface of the member 44 when the automatic inflator mechanism is cocked and the combination of the housing and capsule 14 have not as yet been mounted upon the manual inflator 10.

It is to be noted that when the piston-like member 44 is in the cocked position shown in FIG. 3, a substantial space exists between the sealing means 34 of the gas capsule and the forward cutting end of the active portion 41 of the piercing pin. This permits the member 44 and the gas capsule 14, under the impetus of spring mechanism now to be described, to gain substantial speed in its movements toward the piercing pin, after it has become uncocked, before the sealing means 34 engages the portion 41 of the piercing pin.

Figure 4:
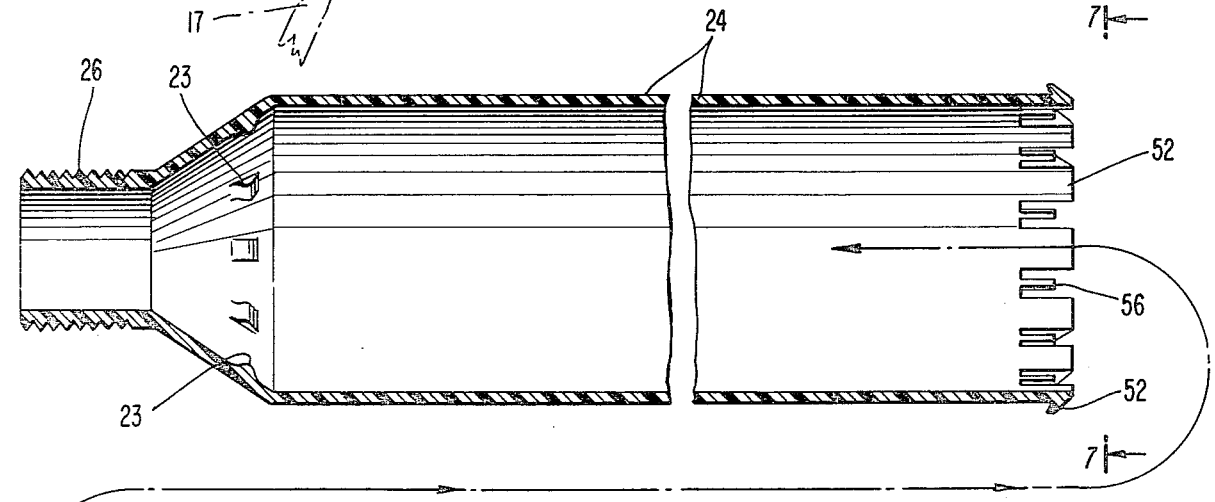
FIG. 4 is an exploded view partially in side elevation and partially in axial section of the mechanism of FIG. 2 for rendering the inflator automatically operable.
Figure 4:
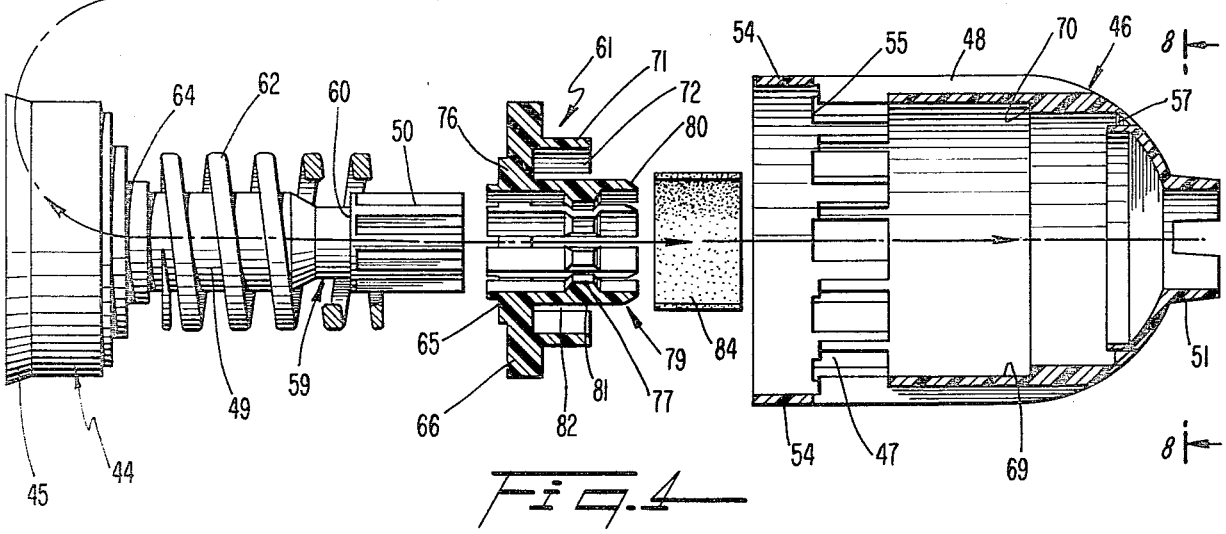
Figure 11:
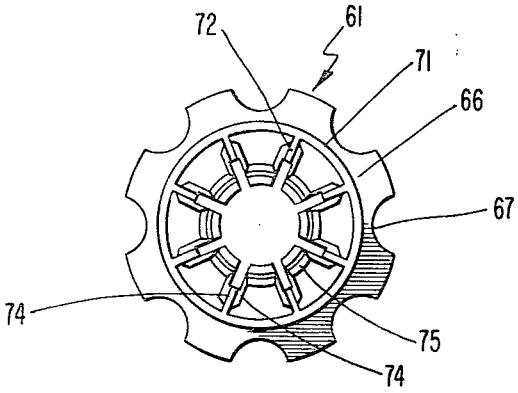
FIG. 11 is a view in end elevation of the plunger-latching means, the view being taken in the direction from right to left in FIG. 4.
Figure 12:
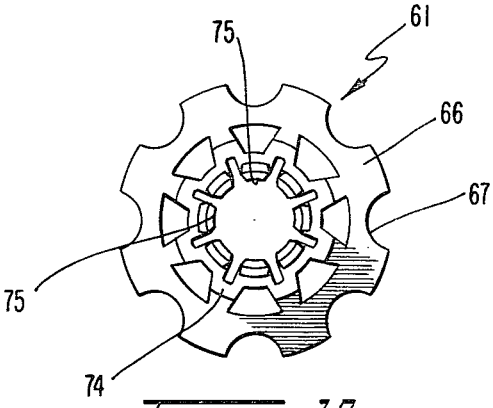
FIG. 12 is a view in end elevation of the latching means of FIG. 11, the view being taken in the direction from left to right in FIG. 4.

In its cocked position, shown in FIG. 3, the member 44 is constantly urged in a direction from right to left by a compressed coil compression spring 62 which acts between a spring seat 64 on member 44 and a spring seat 65 on a latching mechanism 61. The latching mechanism 61 coacts with an annular groove 59 on the stem 49 of member 44 to retain the member 44 in ints cocked position with the spring 62 under compression. The latching mechanism 61, which is shown more specifically in FIGS. 4, 11, and 12, is mounted in an annular seat 69 in the cap 46, the outer edge of the main portion 66 of the latching mechanism 61 abutting an annular shoulder 70 in the cap. The latching mechanism 61 is telescoped over the stem 50, 49 of the plunger 44 as shown in FIG. 3.

Turning now to FIGS. 4, 11, and 12, the latching mechanism 61, which is a preferred embodiment is made of plastic material such as "Delrin" ("Delrin" is the registered trade-mark for an acetal resin made and sold by DuPont) has an axially short sleeve 71 from the rear (right, FIG. 4) end of which there project inwardly a plurality of equally angularly spaced axially short radial posts 74 integral with sleeve 71 and with the body 66 of the latching mechanism 61. Flutes or cutout portions 67 therein facilitate the flow of water inwardly to the water-sensitive member of the latching mechanism 61.

Extending forwardly from each post 74 is a circumferentially thin radial blade 72, blade 72 extending forwardly to terminate in the same transverse plane as the forward edge of the sleeve 71. A plurality of separate, axially extending segments 75 which are spaced circumferentially from each other or which approximate an axially split inner sleeve coaxial of sleeve or skirt 71 are integrally connected at their rear ends and lie between successive posts 74. The points of attachment of the rear ends of the segments 75 to the posts 74 are designated 76. Each segment 75 has a radially inwardly extending lug or tooth 77 integral therewith, the teeth 77 being spaced a substantial distance axially forwardly of the points of attachment 76. The annular groove 59 in the stem 49 of the plunger 44 has diverging beveled end walls, the lugs or teeth 77 having a configuration generally conforming to that of the section of the groove 59 so that they fit therewithin when the plunger is cocked, as shown in FIG. 3.

The forward ends of the segments 75 extend substantially axially forwardly of the forward edges of the sleeve or skirt 71 and the blades 72, as shown in FIG. 4. The forward ends 79 of the segments have their forward, radially outer edges beveled at 80 as shown, the radially outer edges 81 of the segments, rearwardly of the beveled portion 80, being straight and lying along the surface of a circular cylinder in the position of the segments shown in FIG. 4. There is thus presented an annular space 82 between the radially outer edges 81 of the segments 75 and the radially inner edges of the blades 72.

Into such annular space 82 there is thus a thin, sleeve-like coil 84 of water-soluble paper which, when dry, is backed up between the radially outer edges 81 of the segments 75 by the radially inner edges of the blades 72 has sufficient strength to retain the segments in the position shown in FIG. 3 against the outwardly directed force exerted upon them by the interaction between the rear beveled wall of the groove 59 in the stem 49 of the plunger and the correspondingly beveled rear edge of each of the lugs or teeth 77. It will be seen that the coil of paper 84 is under both tension and compression, the tension arising by reason of its engagement with the edges 81 of the segments 75, and the compression arising by reason of its being jammed between the radially inner edges of the blades 72 and the immediately adjacent two segments 75.

Upon the immersion of the inflator 10, 22 in water, as by reason of the ditching of an aviator provided with a Mae West life-saving vest, water seeps into the interior of the housing 24, 46 and weakens or dissolves the paper coil 84 to such an extent that the expansive force of spring 62 drives the plunger 44, 49 forwardly so that it in turn drives the gas capsule 14 against the piercing pin and into the position shown in FIG. 6. As the plunger 44, 49 moves forwardly, the lugs 77 move out of the annular groove 59 and distort the inner ring or sleeve formed by the segments 75 as shown in FIG. 6, the outer end of the stem 50 then sliding freely past the now pried-apart lugs 77 of the segments 75.

Although the invention is illustrated and described with reference to a single preferred embodiment thereof, it is to be expressly understood that it is in no way limited to the disclosure of such a preferred embodiment, but is capable of numerous modifications within the scope of the appended claims.

What is claimed is:

1. In an automatic inflator for gas-inflatable articles, said inflator having a body, a gas capsule-holding means on the body, a capsule-piercing pin, a plunger for advancing the piercing pin and capsule relatively toward each other to pierce the capsule, the plunger having a stem, a transverse surface on the stem, resilient means which when stressed constantly urges the plunger and the percing pin relatively toward each other, and a latching means cooperating with the transverse surface on the stem for selectively holding the plunger from movement toward the piercing pin, the improved latching means which comprises a sleeve telescoped about the plunger, the sleeve being made up of a plurality of axially extending segments having teeth on the inner surface thereof in engagement with the transverse surface on the plunger when the plunger and piercing pin are in the cocked position relative to each other, the segments of the sleeve being mounted for being swung radially outwardly to free the teeth from engagement with the transverse surface, a water-destructible ring disposed around the segments to hold the teeth thereon in engagement with the transverse surface on the plunger, and means engaging the outer surface of the ring in locations between the segments of the sleeve to hold the ring in compression in the spans thereof between such means and successive segments of the sleeve.

2. The apparatus according to claim 1, wherein the latching means has an annular body, means mounting the segments of the sleeve on the annular body adjacent a first end of such segments, and wherein the teeth on the segments are disposed intermediate their axial length, and the ring engages the segments at least adjacent the other, second end thereof.

3. Apparatus according to claim 2, wherein the means engaging the outer surface of the ring comprises a plurality of axially extending radial blades on the body of the latching means, said blades being disposed between successive segments of the sleeve.

4. The apparatus of claim 3, wherein the latching means, including the body, the segments of the sleeve, the teeth on the segments, and the blades are made as an integral member.

5. Apparatus according to claim 4, wherein the latching means is integrally molded of plastic material.

6. The apparatus of claim 1, wherein the capsule-holding means comprises a housing having a circular cylindrical sleeve secured at one end to the body of the inflator, a cap secured to the other end of the sleeve, the gas capsule being slidably mounted within the housing longitudinally thereof, the plunger being disposed within the sleeve adjacent the cap thereon, the plunger having a piston sealingly engaging the inner surface of the sleeve, the piston being adapted to engage the outer end of the capsule and thrust it toward the piercing pin, the stem extending centrally from the piston in an outward direction through a central opening in the cap, and the latching means cooperates with the stem which passes therethrough, the latching means being disposed in a seat within the cap.

7. Apparatus according to claim 6, wherein the cap has openings therethrough to permit the passage of water inwardly to the latching means disposed outwardly of the piston in the sleeve.

8. Apparatus according to claim 1, comprising means for selectively operating the inflator manually including manually operated means for thrusting the pin toward the capsule.

9. Apparatus according to claim 8, comprising means for holding the piercing pin fixed relative to the body when the inflator is in its automatically operating mode, and wherein the manual and automatic modes of operation of the inflator are independent of each other.

10. Apparatus according to claim 8, comprising a housing for the capsule, and wherein the body of the inflator is generally in the form of an elongated flat member, the piercing pin is disposed to extend centrally of the body along the length thereof, a cam and lever pivotally mounted adjacent one end of the body and cooperating with the piercing pin to thrust it toward the capsule when the inflator is operating in its manual mode, and the housing is secured to the other end of the body of the inflator coaxial of the piercing pin.

11. Apparatus according to claim 10, wherein the cam is circular in configuration about a pivot pin therefor beyond the high point of the cam, the piercing pin remains in the capsule following its manual advance toward the capsule, and the piercing pin is of such configuration as to permit the passage of gas from the capsule between the shank of the active end of the piercing pin and the edge of the hole cut in the capsule by the piercing pin.

12. Apparatus according to claim 10, wherein in the automatic mode of operation of the inflator the cam holds the piercing pin from retraction when the cam and the cam lever are in their retracted, inoperative position, so that the inflator is in readiness for movement of the capsule toward the then-fixed piercing pin in the automatic mode of operation of the inflator.

13. Apparatus according to claim 12, wherein the forward active end of the piercing pin has a frusto-conical shank, the larger end of such shank being disposed at the outer end of the pin and having a cutting edge thereon, gas from the pierced capsule passing through an annular opening between the inner edge off the hole cut in the capsule and a reduced diameter portion of the frusto-conical shank of the piercing pin.

14. A latching means adapted for use in an automatic inflator for gas-inflatable articles, said inflator having a body, a gas capsule-holding means on the body, a capsule-piercing pin, a plunger for advancing the piercing pin and capsule relatively toward each other to pierce the capsule, the plunger having a stem a transverse surface on the stem, resilient means which when stressed constantly urges the plunger and piercing pin relatively toward each other, and a latching means cooperating with the transverse surface on the stem for selectively holding the piercing pin and the plunger from movement toward each other, said latching means comprising a sleeve adapted to be telescoped about the plunger, the sleeve being made up of a plurality of axially extending segments having teeth on the inner surface adapted to engage the transverse surface on the plunger when the plunger and piercing pin are in the cocked position relative to ech other, the segments of the sleeve being mounted for being swung radially outwardly to free the teeth from engagement with the transverse surface, a water destructible ring disposed around the segments to hold the teeth thereon in engagement with the transverse surface on the plunger, and means engaging the outer surface of the ring in locations between the segments of the sleeve to hold the ring in compression in the spans thereof between such means and successive segments of the sleeve.

* * * * *